US005275220A

United States Patent [19]

Siegal

[11] Patent Number: 5,275,220

[45] Date of Patent: Jan. 4, 1994

[54] VISUAL PRIVACY SYSTEM FOR OPEN PLAN FURNITURE ARRANGEMENT

[76] Inventor: Burton L. Siegal, 7605 N. Tripp, Skokie, Ill. 60076

[21] Appl. No.: 932,724

[22] Filed: Aug. 20, 1992

Related U.S. Application Data

[63] Continuation of Ser. No. 659,611, Feb. 25, 1991, abandoned.

[51] Int. Cl.[5] ..... A47H 1/00

[52] U.S. Cl. ..... 160/24; 292/189; 292/244; 292/162; 160/DIG. 8; 160/89

[58] Field of Search ..... 160/23.1, 26, 29, DIG.; 52/239, 64, 222; 292/189, 244, 162

[56] References Cited

U.S. PATENT DOCUMENTS

| | | | |
|---|---|---|---|
| 778,228 | 6/1904 | Dodge . | |
| 800,111 | 9/1905 | James . | |
| 1,371,149 | 3/1921 | Dudek | 160/23.1 X |
| 1,958,695 | 5/1934 | Claus | 160/23.1 |
| 2,187,408 | 1/1940 | Thumm | 52/239 |
| 2,876,471 | 3/1959 | Kraemer | 160/23.1 X |
| 2,915,151 | 12/1959 | Kekenak | 189/34 |
| 3,090,424 | 5/1963 | Carlo | 160/23.1 |
| 3,491,400 | 1/1970 | Hubbard | 160/206 X |
| 3,500,894 | 3/1970 | Pofferi | 160/22 |
| 3,842,890 | 10/1974 | Kramer | 160/26 |
| 4,480,676 | 11/1984 | Solomon | 160/290.1 X |
| 4,480,862 | 11/1984 | Fleming | 292/162 |
| 4,821,786 | 4/1989 | Johnston | 160/23.1 |

*Primary Examiner*—Blair M. Johnson

*Attorney, Agent, or Firm*—Lee Mann Smith McWilliams Sweeney & Ohlson

[57] ABSTRACT

A system for providing temporary visual privacy across an interval in a modular open plan furniture arrangement. A horizontally retractable panel is situated at one side of the interval. The retractable panel is provided with means for drawing the panel closed across the interval, and is also provided with means for securing the panel in the closed position. In the preferred form of the invention, the panel comprises a flexible material coiled about a vertically oriented, spring loaded roller lodged within a housing.

14 Claims, 5 Drawing Sheets

VISUAL PRIVACY SYSTEM FOR OPEN PLAN FURNITURE ARRANGEMENT

This application is a continuation, of application Ser. No. 659,611, filed Feb. 25, 1991, now abandoned.

BACKGROUND OF THE INVENTION

This invention relates to modular open plan furniture arrangements, and in particular to a system for providing temporary visual privacy across an interval provided in the open plan furniture arrangement.

Modular open plan furniture arrangements are generally composed of a series of vertical panels that may be joined together to define a work space for an office worker or series of workers. The panels may be used in conjunction with desks and other furniture elements that stand upon the floor or are hung from the panels.

While such systems are in worldwide use and account for a substantial percentage of the total sales of office furniture, in spite of their wide popularity, probably the most common complaint from workers using modular open plan furniture is a lack of privacy. In response to this shortcoming, some of the dozens of manufacturers of these systems have offered a hinged door as an attempt to deal with the need. A conventional door, however, fails to recognize the real nature of the need and the structure to which the door is to be added, namely; portable, flexible, loosely-positioned furniture. Furthermore, openings to a work station or intervals in a modular open plan furniture arrangement can be any width from 22 inches to over 60 inches. Also, the panels normally are rarely leveled exactly plumb so that the width of the opening may vary from top to bottom. Doors currently provided are commonly supplied with a threshold that both engages adjacent panels and functions to try to control the width at the bottom to the exact width required by the door in order to properly close and latch. Most of such systems also supply a header member to control the width at the top. The header member must, of necessity, require that the door be of a conventional height so that an individual's head will cleanly clear the header.

The most common height employed in modular open plan furniture arrangements is approximately 60 inches, while a conventional door frame requires approximately 84 inches in height. Raising the panel system to meet the height of the door is highly undesirable as it is more expensive, blocks lateral lighting, and tends to make small work stations seem as if they are much smaller than actual. In addition, a hinged door requires clear floor space to allow it to open so that individuals may pass through the opening. With office rental costs reaching considerably high levels, it is imperative that every square foot of space be utilized, rather than becoming wasted space to accommodate the swing of a door. Furthermore, space planners are severely restricted in layouts of work stations if the layouts are limited to only one or two potential opening widths that can be covered by a conventional door.

Conventional door systems ignore the fact that the privacy complaint of office workers is not for physical privacy, but rather for visual privacy. The continual flow of office workers passing an opening provides not only a distraction, but also an invitation to intrude, interrupting the thought process and therefore reducing efficiency.

Therefore, the following are realistic requirements for an ideal system for providing visual privacy:

1. It should provide standing visual privacy.
2. It should be capable of being made to any height that the modular open plan furniture arrangement employs.
3. It should blend into the system, accomplishing its purpose with a minimum of visual and physical discord with the modular open plan furniture arrangement.
4. It should be a physical barrier to entry.
5. It should be able to span any conventional work station opening or interval between 22 inches and at least 60 inches, or more.
6. It should require no modification to a conventional open plan furniture arrangement, and should be unaffected by shifts in position of either or both panels defining an opening or interval in the modular open plan furniture arrangement.
7. A single unit should be able to cover the entire range of width, while accommodating the finishes and colors offered in the modular open plan furniture arrangement.
8. The device should be inexpensive, yet not look cheap. It must maintain the quality image of the open plan furniture arrangement with which it is to be used.
9. When not in use, the device should be as small and inconspicuous as possible.
10. The device must be durable.
11. The device must be quick and easy to use.
12. The device must be easily and quickly installed and removed from the open plan furniture arrangement as such arrangements are intended to be frequently rearranged.
13. The device must not waste space either inside or outside the work station as does a conventional swinging door.
14. The device must not pose any safety hazards.
15. The device must be capable of being easily packaged and shipped at low cost and without damage.

SUMMARY OF THE INVENTION

The invention meets the requirements for an ideal visual privacy system by providing a system which permits temporary visual privacy across an interval in a modular open plan furniture arrangement. The system includes at least one modular panel adjacent the interval, with the modular panel having a particular exterior design configuration. A horizontally retractable panel is situated at one side of the interval, with the retractable panel having an exterior design configuration conforming to that of the modular panel. Means is provided for drawing the retractable panel to a closed position across the interval, and means is provided for securing the retractable panel in the closed position.

In accordance with the preferred form of the invention, the retractable panel comprises a flexible material which is coiled about a vertically oriented, spring loaded roller. The means for drawing the retractable panel closed comprises a rigid vertical edge member which is attached to the free end of the material and which has a hand pull for closing the retractable panel.

In accordance with the preferred form of the invention, for securing the retractable panel when deployed, the system includes a tongue-and-groove construction having a tongue portion engaging a groove portion. One of the portions is secured to and extends substantially the length of the edge member, while the other of the portions is located at the opposite side of the interval in order to be engaged as the retractable panel is closed. It is preferred that the one portion attached to the edge member is located in registration with the flexible material to ease closing of the retractable panel.

For latching of the retractable panel in the closed position, the tongue includes a latch slot and the groove includes a latch pin aligned with the slot, with the slot being engageable by the pin. The slot is preferably located equidistant between opposite ends of the tongue, so that the system according to the invention can be used universally to be deployed in any orientation and on either side of an interval in a modular open plan furniture arrangement.

In accordance with the preferred embodiment of the invention, the spring loaded roller is mounted in a housing, with the housing having a longitudinal gap through which the coiled material is withdrawn and retracted. Preferably, the rigid vertical edge member is shaped to conform to the gap and cover the gap to complete the outer aesthetic features of the housing when all of the coiled material is retracted into the housing.

Also in accordance with the preferred embodiment of the invention, the vertical edge member attached to the free end of the flexible material has seating guides at each end, and the housing includes end caps at opposite ends in alignment with the seating guides. Each end cap includes means to engage an aligned seating guide to properly seat and orient the edge member when the panel is retracted. Preferably, the seating guide includes inclined seating tapers, and each end cap is correspondingly provided with seating tapers so that the edge member is properly seated both horizontally and vertically when retracted to the housing.

The retractable panel is typically drawn across an opening that is carpeted or provided with a hard floor surface. To aid in closing of the retractable panel and properly align the retractable panel, the edge member may include a roller or skid secured to the bottom of the edge member. In many applications, the roller or skid is unnecessary, and may be eliminated.

BRIEF DESCRIPTION OF THE DRAWINGS

The invention is described in greater detail in the following description of examples embodying the invention, taken in conjunction with the drawing figures, in which.

DESCRIPTION OF EXAMPLES EMBODYING THE BEST MODE OF THE INVENTION

Figure 1:
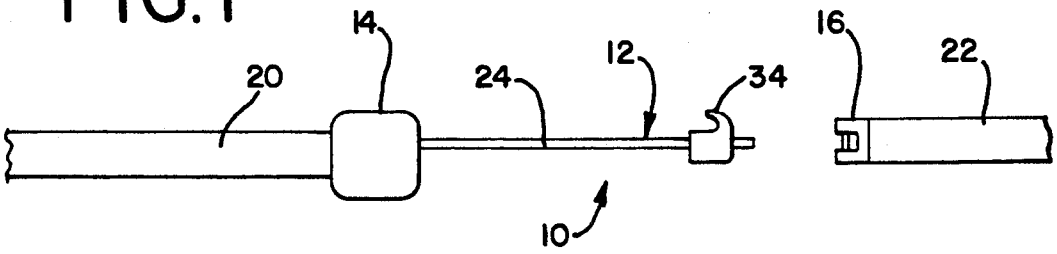
FIG. 1 is a top plan schematic view of a system according to the invention when employed in an interval in a modular open plan furniture arrangement, and with the horizontally retractable panel partially deployed.

A system according to the invention for providing temporary visual privacy is generally designated at 10 in the drawing figures. As primary components, the system 10 includes a retractable panel 12 emerging from a housing 14, and which can be latched to a jamb strip 16. The system 10 is installed in an interval 18 between spaced modular panels 20 and 22 of a modular open plan furniture arrangement. As will become apparent below when reviewing alternative forms of the invention, the panels 20 and 22 need not be aligned for proper functioning of the system 10, it being required only that there be an interval 18 of some nature in a modular open plan furniture arrangement such that the housing 14, with the retractable panel 12, and the jamb strip 16 can be mounted generally in registration with one another.

The retractable panel 12 comprises a length of flexible material 24 wound onto a vertically oriented, spring loaded roller 26 located within the housing 14. The roller 26 is provided with a conventional retraction spring (not illustrated) for retracting the retractable flexible material 24 within the housing 14. The housing 14 is sized appropriately to accommodate the desired quantity of flexible material 24 wound upon the roller 26 within the housing 14.

One end of the flexible material 24 is secured to the roller 26. The other, free end of the flexible material 24 is secured within a rigid vertical edge member 28, which is best shown in FIGS. 3, 4, 9 and 10. The material 24 is appropriately and permanently captured in a convention fashion within a longitudinal channel 30 formed in the edge member 28. Thus, when the edge member 28 is pulled away from the housing 14, the flexible material 24 will follow the edge member 28 and be withdrawn from the roller 26.

Figure 9:
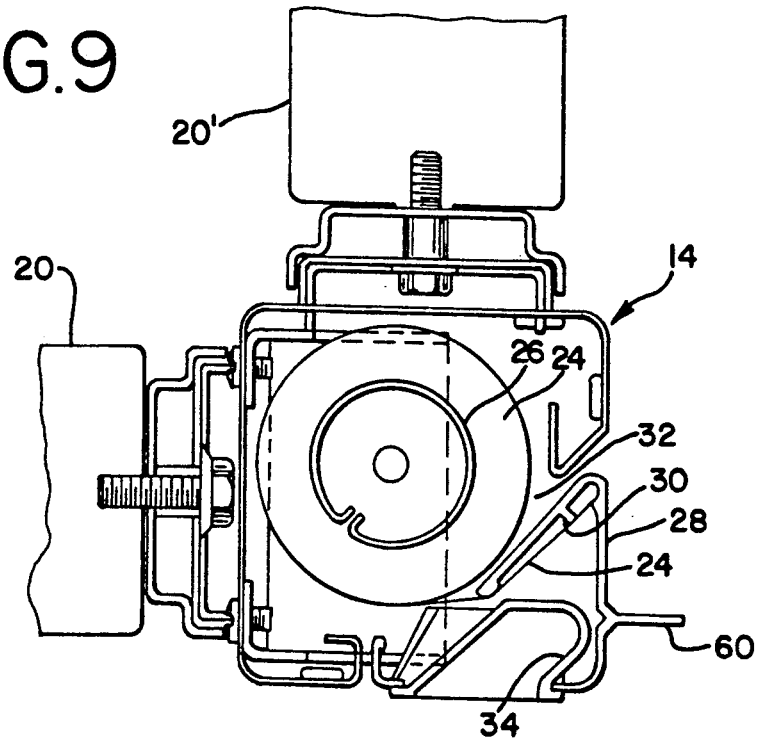
FIG. 9 is a top sectional view of a housing and retractable panel according to the invention, and showing two different possible mounting orientations on an adjacent modular panel of a modular open plan furniture arrangement.

The flexible material 24 emerges through a longitudinal gap 32 formed in the housing 14. As best shown in FIG. 9, the exterior of the edge member 28 is shaped to conform to the exterior of the housing 14, so that when the retractable panel 12 is retracted with the edge member 28 across the gap 32, the edge member 28 forms as closely as possible to a continuation of the exterior configuration of the housing 14.

Figure 3:
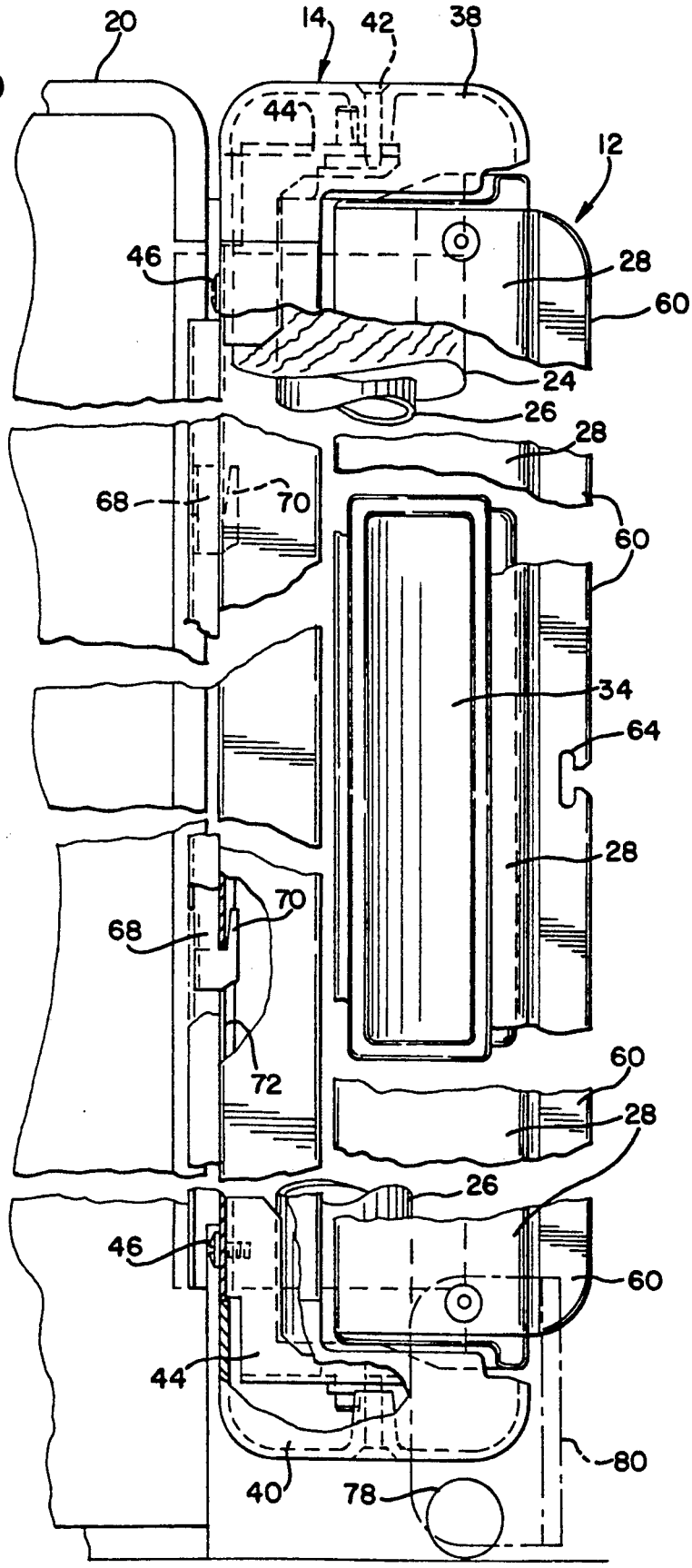
FIG. 3 is an enlarged elevational view, partially in cross section, partially with portions broken away, and partially truncated in length for illustration purposes, showing a horizontally retractable panel and housing according to the invention when mounted on a modular panel of a modular open plan furniture arrangement.
Figure 10:
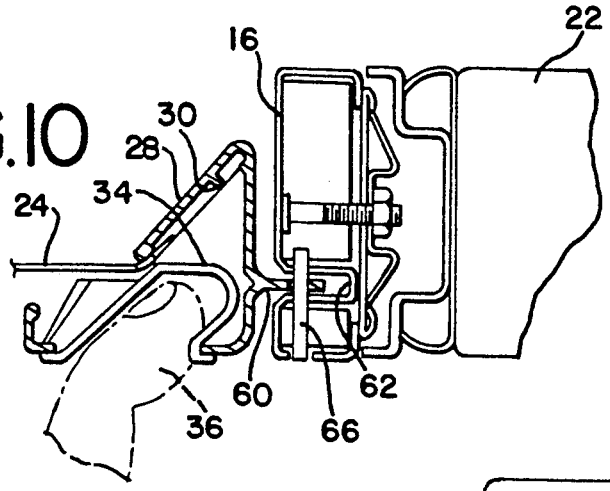
FIG. 10 is a top plan view, partially in cross section, showing engagement of the retractable panel in the closed position.

The edge member 28 is provided with a pull 34. Preferably, the pull 34, as illustrated in FIGS. 3, 9 and 10, is an internal pull extending within the edge member 28 so that the force vector of the tension of the material 24 on the pull 34 is placed as close as practical to tips of the fingers 36 of a user. This is done to minimize the torque moment on the pull 34 tending to make it rotate around the tips of the user's fingers 36. Such a moment makes control for latching more difficult and increases the perception of the user of the amount of force required to operate the retractable panel 12.

Figure 4:
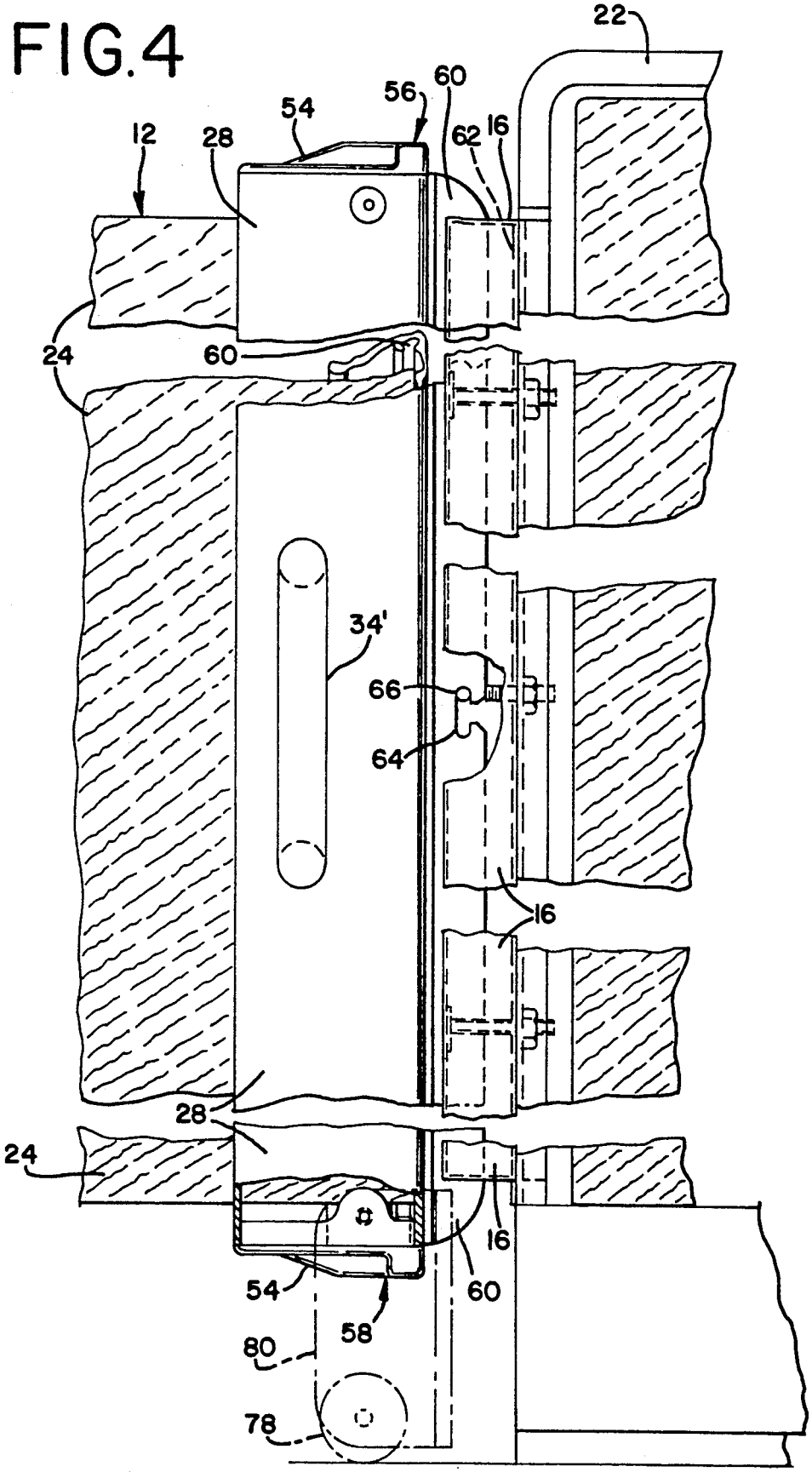
FIG. 4 is an elevational view, partially in cross section, partially with portions broken away, and truncated in length to eliminate redundancy, showing a horizontally retractable panel when closed and engaged at the opposite side of an interval in a modular open plan furniture arrangement, and showing a second form of pull for closing the retractable panel.
Figure 5:
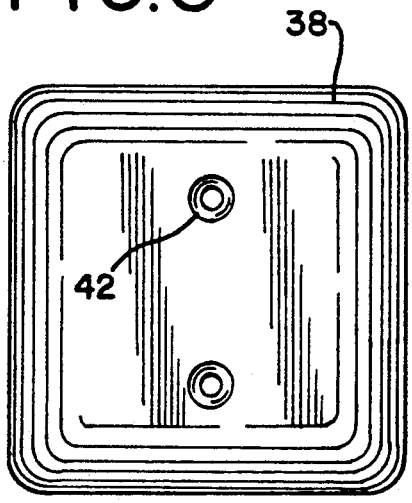
FIG. 5 is a top plan view of an end cap for the housing for the horizontally retractable panel.
Figure 6:
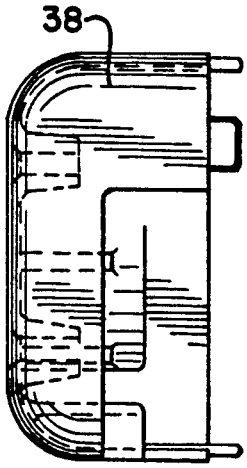
FIG. 6 is a side view thereof.
Figure 7:
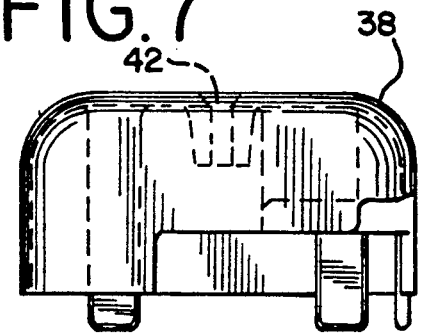
FIG. 7 is a side view thereof, of a side 90° disposed from that of FIG. 6.
Figure 8:
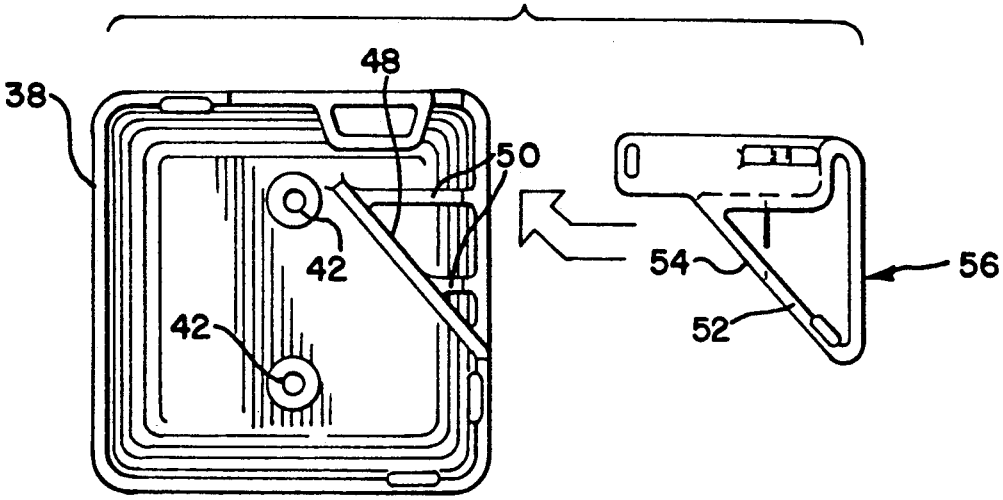
FIG. 8 is a bottom plan view thereof, showing also a seating guide for the retractable panel as it seats within the end cap.
Figure 11:
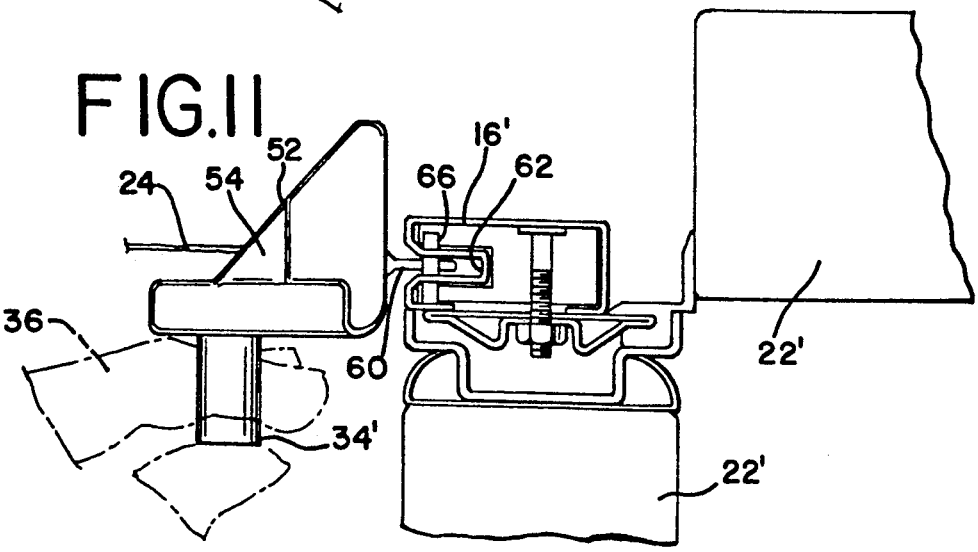
FIG. 11 is a top plan view similar to FIG. 10 of an alternative form of mounting for closure of the retractable panel, and showing a second form of hand pull for the retractable panel.

While preferably the internal pull 34 is employed, alternatively, an external pull 34' can be used, as illustrated in FIGS. 4 and 11. Because the user's fingers 36 are spaced a greater distance from the material 24 than is the case when the pull 34 is illustrated (compare the spacing in FIGS. 10 and 11), a greater torque moment is experienced using the pull 34', increasing the user's perception of the force necessary to operate the retractable panel 12.

The opposite ends of the housing 14 are finished with end caps 38 and 40. While the end caps 38 and 40 are generally identical to one another in exterior configuration, as will become apparent below, internally the end caps 38 and 40 are mirror images of one another. Thus, only the end cap 38, shown in additional detail in FIGS. 5–8, will be described in detail.

The end cap 38 is provided with a pair of screw apertures 42 for fastening to an internal bracket 44 (FIG. 3). The bracket 44, in turn, is secured to the housing 14 by screws 46. The bracket 44 is formed to accommodate the ends of the roller 26, and hold the roller 26 in place within the housing 14, as best illustrated in FIG. 3. One of the brackets 44 may include a bushing for the axle of the roller 26, while the other bracket 44 may have a slot engaging and retaining a blade protruding from the roller 26, similar to common window shades.

Internally, the end cap 38 includes an inclined seating taper 48 and an inclined seating taper 50. The seating tapers 48 and 50 are formed to engage correspondingly inclined seating tapers 52 and 54 of a seating guide 56 installed in one end of the edge member 28. A similar seating guide 58, formed as a mirror image of the seating guide 56, is mounted at the opposite end of the edge member 28, and engages the end cap 40 in an identical fashion. As shown by the arrow in FIG. 8, when the seating guide 56 engages the end cap 38, the seating taper 48 engages the seating taper 52, and the seating taper 50 engages the seating taper 54. Given tension on the material 24, the seating tapers 48 and 50 in the end caps 38 and 40, and the seating tapers 52 and 54 in the seating guides 56 and 58, cause the edge member 28 to be guided into proper orientation in relation to the housing 14, as best shown in FIGS. 3 and 9.

The edge member 28 includes an extending tongue 60 which, when the retractable panel 12 is extended, engages a groove 62 in the jamb strip 16. The tongue 60 is provided with a T-shaped latch slot 64 shaped to engage a latch pin 66 which spans the groove 62. It is preferred that the latch slot 64 be located equidistance between the ends of the tongue 60 so that the edge member 28 is universal; that is, the edge member 28 can be used for a left-to-right retractable panel, or a right-to-left retractable panel. In addition, because the tongue 60 does not seat at the bottom of the groove 62 when the retractable panel 12 is latched to the jamb strip 16 (FIGS. 10 and 11), a single latch point formed by the center latch slot 64 and latch pin 66 permits the housing 14 and jamb strip 16 to be out of plumb without affecting latching, and without causing a loss of tension in the flexible material 24, resulting in an unsightly sag of the material. Finally, the tongue 60 inserted within the groove 62 eliminates any visual crack between the edge member 28 and the jamb strip 16.

A second form of the jamb strip 16 is shown at 16' in FIG. 11. The jamb strip 16' includes an identical groove 62 and latch pin 66, and is simply shaped to accommodate a modular open plan furniture arrangement where two modular panels 22' meet at right angles, or where the modular panel 22' and retractable panel 12 meet at right angles. The jamb strips 16 or 16' may be affixed to the respective modular panels 22 or 22' in a conventional fashion, not forming part of the invention.

For mounting the housing 14 on the modular panel 20, pairs of brackets 68 (FIG. 3) are secured to the panel 20, the brackets 68 having a series of hooks 70 which engage corresponding slots 72 formed in the housing 14. It is desireable to space the hooks 70 symmetrically with respect to the height of the panel 20, and also space the slots 72 symmetrically with respect to opposite ends of the housing 14 so that the housing 14 can be removed from the hooks 70, turned end-for-end, and replaced on the hooks 70 so that the facing side of the material 24 can be reversed, as required. Thus, the housing 14, and internal retractable panel 12, are formed symmetrically with respect to the slot 64 to permit the orientation of the retractable panel 12 to be reversed.

Figure 2:
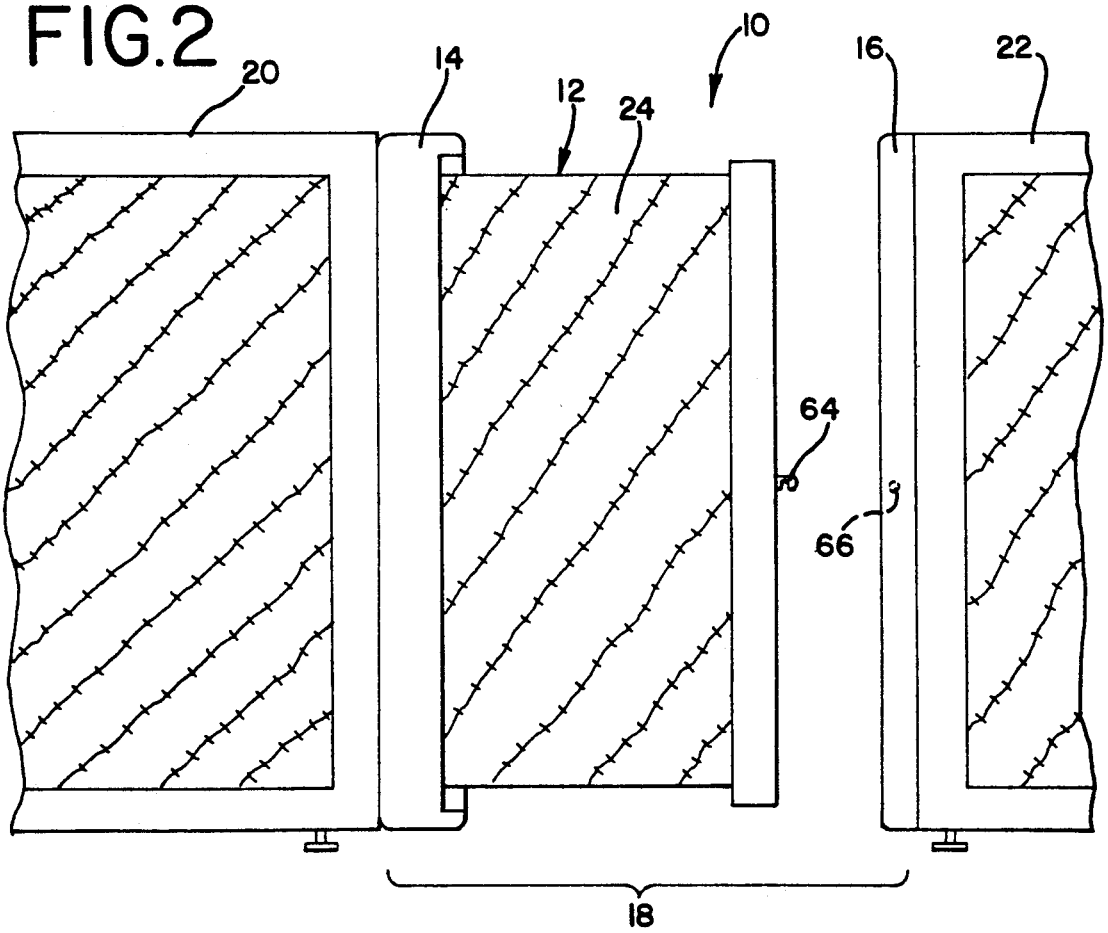
FIG. 2 is a front elevational view thereof.

As depicted in FIG. 2, it is preferred that the flexible material 24 match the exterior design configuration of the adjacent modular panels 20 and 22, for aesthetic purposes. It is preferred that the upper and lower edges of the material 24 terminate to approximate the height of the adjacent modular panels, in order to match as closely as possible the overall visual impact of the open plan furniture arrangement in which the system 10 according to the invention is employed.

It is anticipated that the retractable panel 12 will be withdrawn from and returned to the housing 14 numerous times, and thus the edges of the fabric forming the flexible material 24 might be susceptible to wear and fraying if the retractable panel 12 is not handled carefully. It is thus preferred that the top and bottom edges 74 and 76 of the fabric 24 be painted with a high solids paint to give the material 24 a finished look and deter fraying, rather than applying a trim strip or something similar. A trim strip would increase the thickness of the material 24 only at the edges 74 and 76, thus inhibiting proper retraction of the panel 12, and also increasing the required dimensions of the housing 14.

Since the material 24 is preferably simply a fabric, or a fabric laminated on a more substantial backing material, the retractable panel 12, when withdrawn from the housing 14, is quite free and flexible. In order to properly guide the retractable panel 12 and orient the latch slot 64 with the latch pin 66, the edge member 28 may be provided with a guide wheel 78, mounted in a bracket 80 secured to the bottom of the edge member 28. Alternatively, the wheel 78 can be omitted, or a skid surface or similar treatment can be employed. If used, the bracket 80 and wheel 78 can be reversed and used at the opposite end of the edge member 28 should it be desired to reverse the housing 14.

Achievements

The invention provides a collapsible or retractable panel that is unobtrusive when not deployed, yet when deployed, provides a visual continuation of the modular open plan furniture arrangement with which it is used, and also provides needed visual privacy. The edge member 28, when shaped to conform to the outer configuration of the housing 14, provides an aesthetically compatible completion of the housing, making it that much less obtrusive.

The length of the flexible material 24, and therefore the width of an interval 18 that can be spanned, is dictated only by the internal width of the housing 14 and thickness of the flexible material 24. The thinner the material 24, the greater the amount that can be wound on the roller 26 within the confines of a particular housing 14. Thus, a single system 10 according to the invention can be employed to span interval widths varying greatly, whereas conventional doors and the like require a different item for each different width.

The depth which the tongue 60 penetrates the groove 62 is dictated by the depth of the groove 62, location of the latch pin 66, and depth of the latch slot 64. As shown in FIGS. 4, 10 and 11, the tongue 60 does not penetrate to the bottom of the groove 62 when the panel 12 is deployed, thus accommodating the jamb strip 16 being out of parallel with the housing 14. With a single latching point being employed, a substantial degree of being out of parallel can be accommodated without resulting in a loss of tension in the top or bottom of the flexible material 24 caused by seating of the tongue 60 at the bottom of one end or the other of the groove 62. Also, penetration of the tongue 60 within the groove 62 prevents formation of any visual gap between the edge member 28 and the jamb strip 16. In addition, the tongue and groove configuration assures proper planar alignment of the retractable panel 12 with the adjacent modular panel 22, since with use of only a single latch point, the panel 12 could otherwise tend to rotate about the latch point formed by the latch slot 64 and the latch pin 66. This is due to the fact that the flexible material 24 has little or no torsional stiffness.

The symmetry of the system 10 about the latch slot 64 allows the system 10 to be mounted on either side of an interval 18, with its facing of the flexible material 24 in either direction. Thus, a single system 10 can accommodate any interval 18, no matter which direction the material 24 is to face, and no matter which side of the interval 18 the retractable panel is to be mounted.

The latch slot 64 is "T" shaped to enhance the universality of the system 10. As illustrated in FIG. 3, the slot has a slight reverse slant to supplement gravity in holding the retractable panel 12 in place when the latch slot 64 is engaged on the latch pin 66.

As shown in FIG. 2, the flexible material 24 is finished on one side to match the adjacent modular panels 20 and 22. The opposite side of the material 24 (not illustrated) could be finished with a reflective surface facing within the work station to give the user the dual opportunity to use the retractable panel 12 as a visual privacy screen, as well as a projection screen.

The system 10 does not require significant space on either side of the modular panels 20 and 22, and occupies only a small part of the interval 18 between the panels 20 and 22. Not only is it unobtrusive when retracted, but also deployment of the panel 12 across the interval 18 requires no adjacent space such as that required by a swinging door.

A conventional swinging door or similar structure requires the modular panels 20 and 22 to be coplanar. The flexible retractable panel 12 of the present invention, however, can accommodate modular panels 20 and 22 that are offset from one another to a considerable extent. The versatility of the retractable panel 12 far surpasses that of the conventional swinging door.

The system 10 does not require a threshold bar to create an exact interval between the spaced modular panels 20 and 22, nor does the system 10 require a header bar or the attendant requirement that the height of the interval between the floor and the header bar be over 80 inches. The system 10 also permits a differential in interval width resulting from adjacent panels not being parallel, which is far greater than a conventional swinging door can accommodate.

Various changes can be made to the invention without departing from the spirit thereof or scope of the following claims.

What is claimed is:

1. A system for providing temporary visual privacy in a modular open plan furniture arrangement, comprising a. a modular open plan furniture arrangement having at least one repositionable, modular panel, b. an interval in the open plan furniture arrangement, c. at least one of said at least one modular panels being adjacent the interval, said adjacent modular panel having a particular height, d. a horizontally retractable panel situated at one side of said interval, said retractable panel having a height approximately that of said adjacent modular panel, e. means for mounting said retractable panel in a housing such that said retractable panel can be deployed in multiple directions in relation to said adjacent modular panel, said housing having a longitudinal gap through which said panel is withdrawn and retracted, and said housing including means for detachably securing said housing to said adjacent modular panel such that said housing can be located on either side of said interval for deployment and can be deployed with either side of said retractable panel facing a particular direction, f. means for drawing said retractable panel to a closed position across said interval, and g. means for securing said retractable panel in said closed position.

2. A system according to claim 1 in which said retractable panel comprises a flexible material coiled about a vertically oriented, spring loaded roller, and having a free end.

3. A system according to claim 2 in which said means for drawing comprises a rigid vertical edge member attached to said free end of said material, and including a hand pull.

4. A system according to claim 3 in which said securing means comprises a tongue-and-groove construction having a tongue portion engaging a groove portion, one of said portions being secured to and extending substantially the length of said edge member, and the other of said portions being located at the opposite side of said interval.

5. A system according to claim 4 in which said one portion is located in registration with said material.

6. A system according to claim 4 in which said tongue includes a latch slot and said groove includes a latch pin aligned with said slot, said slot being engageable with said pin.

7. A system according to claim 6 in which said slot is located equidistant between opposite ends of said tongue.

8. A system according to claim 6 in which said latch slot is T-shaped.

9. A system according to claim 2 in which said means for drawing comprises a rigid vertical edge member attached to said free end, said edge member being shaped to conform to said gap and cover said gap to substantially complete said housing when said coiled material is retracted.

10. A system according to claim 2 in which said means for drawing comprises a rigid vertical edge member attached to said free end and having seating guides at each end, and said housing includes end caps at opposite ends thereof in alignment with said seating guides, each end cap including means to engage an aligned seating guide.

11. A system according to claim 10 in which each said seating guide includes an inclined seating taper, and said means to engage comprises a correspondingly inclined seating taper in each said end cap.

12. A system according to claim 10 in which each said seating guide includes a pair of inclined seating tapers, one taper for seating horizontally and one taper for seating vertically, and said means to engage comprises a pair of correspondingly inclined seating tapers in each said end cap.

13. A system according to claim 2 including an edge member attached to said free end, and including means for guiding said flexible material across said interval.

14. A system according to claim 13 in which said means for guiding comprises a roller secured to the bottom of said edge member.

* * * * *